US005715651A

United States Patent [19]

Thebault

[11] Patent Number: 5,715,651

[45] Date of Patent: Feb. 10, 1998

[54] PROCESS AND MACHINE FOR FITTING STRETCHABLE LABELLING SLEEVES ON BOTTLES OR THE LIKE

[75] Inventor: Philippe Thebault, Montdidier, France

[73] Assignee: Protection Decoration Conditionment, Montdidier, France

[21] Appl. No.: 516,190

[22] Filed: Aug. 21, 1995

[51] Int. Cl.[6] ..... B65B 11/00; B65B 53/00

[52] U.S. Cl. ..... 53/399; 53/441; 53/585; 53/556; 53/292

[58] Field of Search ..... 53/399, 441, 585, 53/292, 293, 294, 291, 556

[56] References Cited

U.S. PATENT DOCUMENTS

| | | | |
|---|---|---|---|
| 2,976,661 | 3/1961 | Bagnelle | 53/585 X |
| 3,879,918 | 4/1975 | Lerner | 53/441 |
| 5,433,057 | 7/1995 | Lerner et al. | 53/585 X |

FOREIGN PATENT DOCUMENTS

| | | | |
|---|---|---|---|
| 2032338 | 5/1980 | United Kingdom | 53/292 |
| 1588412 | 4/1981 | United Kingdom | 53/585 |

*Primary Examiner*—Linda Johnson

*Attorney, Agent, or Firm*—Michael R. Schacht; Hughes, Multer & Schacht, P.S.

[57] ABSTRACT

A process for fitting stretchable labeling sleeves on bottles or the like, according to which at least one pair of stretchers is introduced into the sleeve, the stretchers are moved apart in order to stretch the sleeve, and the bottle and the stretchers are displaced relative to one another in order to postion the stretched sleeve on the bottle, which process is characterised in that, during relative displacement of the attached sleeve and the bottle, suction is effected in the area of contact between the sleeve and the stretchers in order to maintain the sleeve on the stretchers while it is being fitted on the bottle.

15 Claims, 3 Drawing Sheets

PROCESS AND MACHINE FOR FITTING STRETCHABLE LABELLING SLEEVES ON BOTTLES OR THE LIKE

According to this process, at least one pair of stretchers is introduced into the sleeve, the stretchers are moved apart in order to stretch the sleeve, and the bottle and the stretchers are displaced relative to one another in order to position the stretched sleeve on the bottle, which process is characterised in that, during the relative displacement of the stretched sleeve and the bottle, suction is effected in the area of contact of the sleeve and the stretchers in order to maintain the sleeve on the stretchers while it is being fitted on the bottle.

According to another feature of the invention, before the suction operation, air is blown into the stretched sleeve in its area of contact with the stretchers.

According to another feature of the invention, when the sleeve has been fitted on the bottle, air is blown into the sleeve in its area of contact with the stretchers while the stretchers and the bottle are displaced relative to one another in order to remove the stretchers from the fitted sleeve.

According to another feature of the invention, during the relative displacement of the stretched sleeve and the bottle, air is blown between the sleeve and the bottle.

The invention relates also to a machine for implementing this process, which machine is characterised in that the stretchers comprise a network of channels which are connected to a suction means and open out on the surface of the stretchers that comes into contact with the sleeve.

The invention is shown by way of non-limiting example in the appended drawings, in which.

Figure 1:
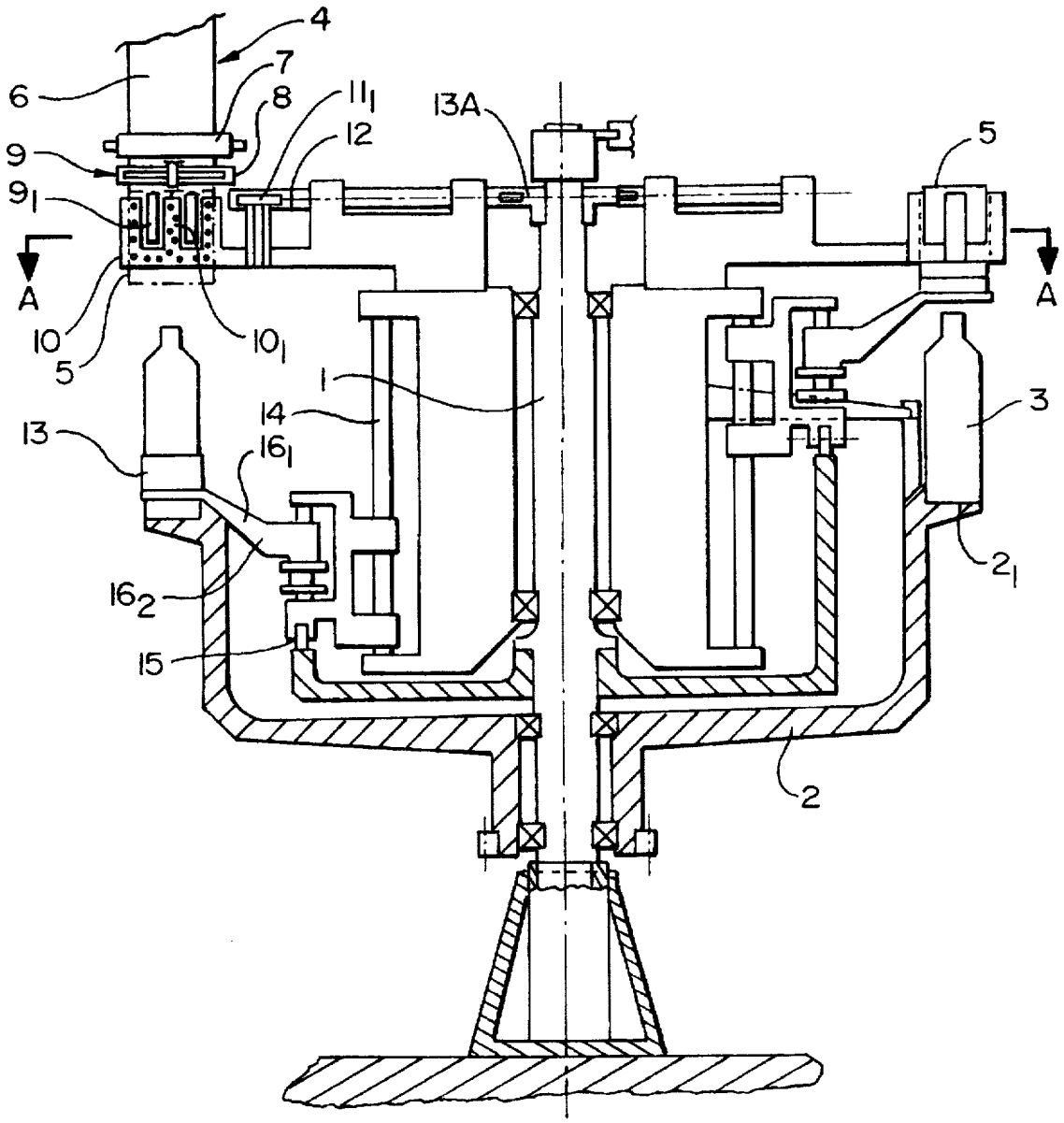
FIG. 1 is a lateral view in axial section of a machine according to the invention.

The aim of the present invention is therefore to provide a process which enables stretchable labelling sleeves to be fitted on bottles, cans or the like at a fast rate which may be of the order of 400 labels per minute. The machine also makes it possible to reduce to practically zero the number of cases where a sleeve is fitted incorrectly or not at all, which is also of considerable importance bearing in mind the manoeuvres which become necessary each time a bottle is not labelled correctly.

The machine shown in the appended drawings ensures the continuous fitting of labelling sleeves and comprises a circulation path for the bottles which is in the form of a barrel comprising a fixed shaft 1 on which are rotatably mounted radial arms 2 which are each provided at their periphery with a station $\mathbf{2_1}$ for receiving a bottle 3 to be labelled.

Arranged above the circular path of the bottles 3 is a fixed station 4 for dispensing sleeves 5 which are separated in succession from a sleeve wrapper 6 wound in a roll. This fixed station thus especially comprises rollers 7 for entraining the wrapper over a length corresponding to that of a sleeve and cutting members 8 which, each time they are actuated, ensure that the end sleeve 5 is separated from the wrapper 6.

The fixed station 4 also comprises a device 9 for supporting the sleeve 5 which has just been separated, this device being formed by a fixed suction surface in the form of a comb and comprising spaced teeth $\mathbf{9_1}$.

The triggering of suction on the face of the comb oriented in the sense of rotation opposite to that of the barrel is preferably effected just shortly before the cutting members 8 are actuated.

Above the area where a bottle 3 is received, each receiving station $\mathbf{2_1}$ comprises another suction plate 10 in the form of a comb of which the teeth $\mathbf{10_1}$ interlock with the teeth $\mathbf{9_1}$ of the fixed comb 9 in the course of the rotation of the barrel in such a manner that each comb 10 entrains, in succession and in a stream, a sleeve 5 separated from the wrapper 6 at the fixed station 4. The sleeve 5, which is initially supported by the comb 9, is thus entrained and supported by the comb 10 above a bottle 3 of a bottle-receiving station.

Each receiving station $\mathbf{2_1}$ also comprises a suction counter-plate 11 pivotably mounted at $\mathbf{11_1}$ on each arm 2, each suction counter-plate being caused to pivot by a rack assembly 12 which is controlled by a cam and roller assembly 13A which is coaxial with the shaft 1.

The cam 13A is arranged in such a manner that, as the barrel rotates, the counter-plate 11 is placed against a sleeve 5 as soon as the latter has been separated from the wrapper 6, the counter-plate 11 then being moved away from the plate 10 in order to open the sleeve as shown at $\mathbf{5_1}$.

Figure 2:
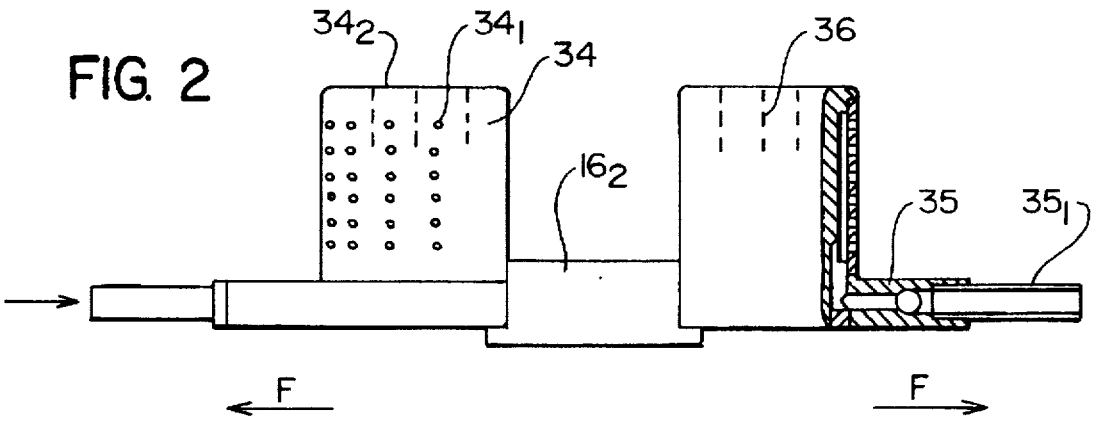
FIG. 2 is a partially sectional lateral view of a pair of stretchers.
Figure 3:
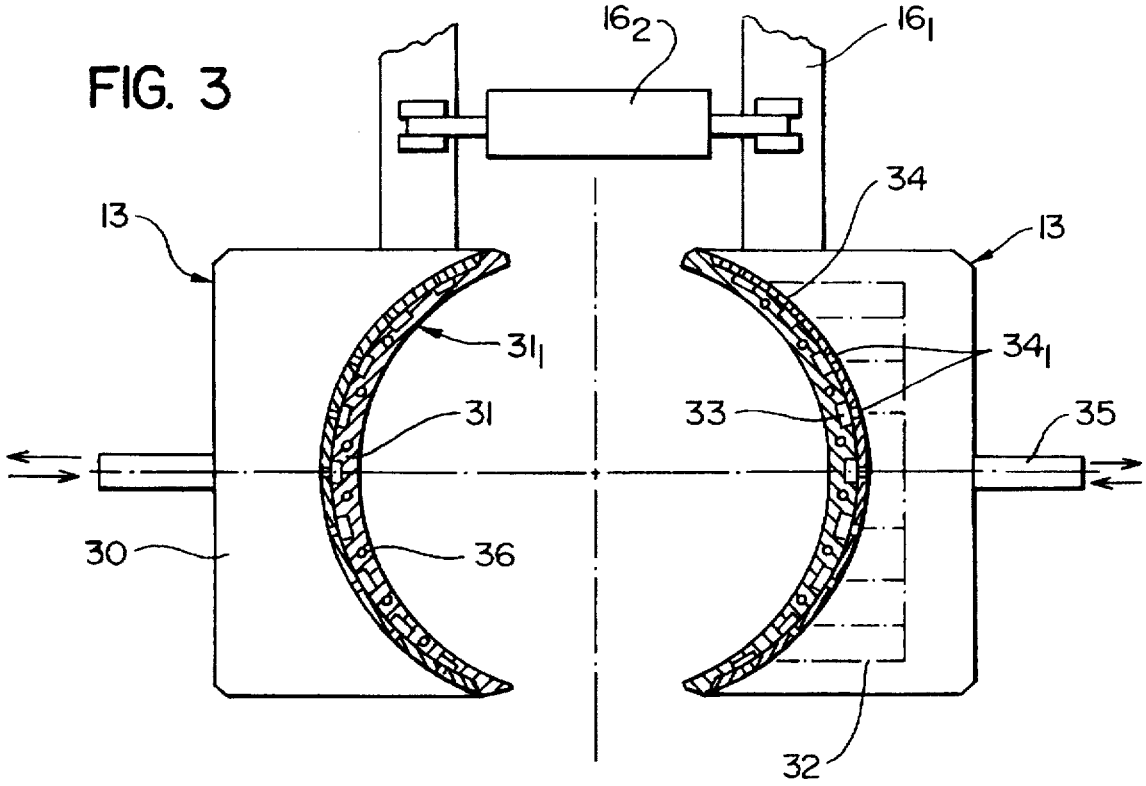
FIG. 3 is a plan view of FIG. 2.
Figure 4:
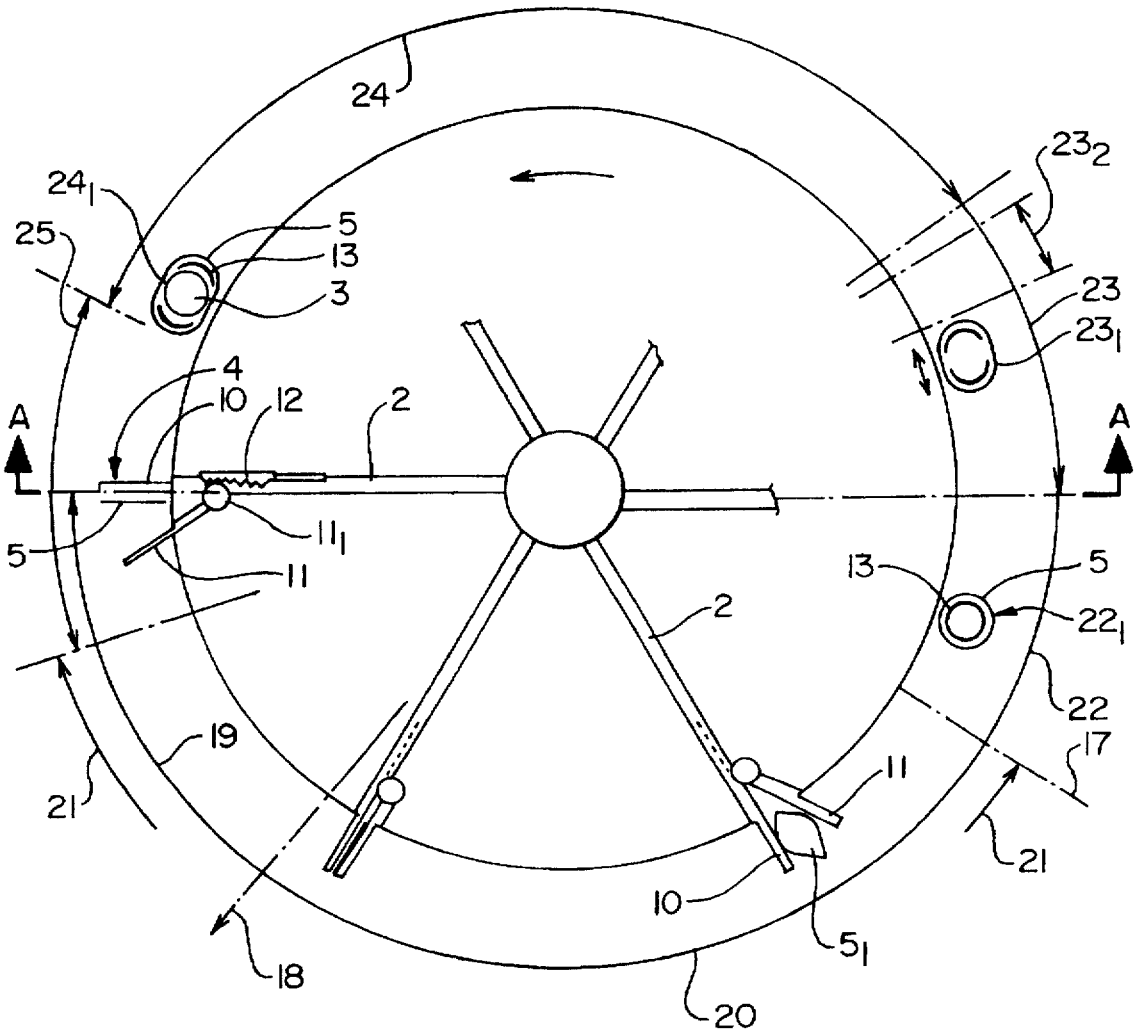
FIG. 4 is a diagrammatic view of the machine of FIG. 1 showing its operating cycle.

Each bottle-receiving station $\mathbf{2_1}$ also comprises a pair of stretchers 13 which are to be accommodated inside a sleeve 5 in order to stretch it transversely and slip it in the stretched state onto a bottle. The stretchers of each pair are supported by an arm $\mathbf{16_1}$ which can move vertically by sliding on a guide column 14 under the action of an assembly 15 comprising a circular cam and a roller. The two stretchers of each set can move apart under the action of a set of levers $\mathbf{16_2}$ (see FIGS. 2 and 3) controlled by a roller (not shown) which is provided at each station and is actuated by a circular cam arranged on a stationary portion of the barrel. The vertical displacement and moving apart of the stretchers 13 are thus controlled in synchronism with the circular movement of the barrel 2 so that the stretchers 13 are introduced into the open sleeve $\mathbf{5_1}$ while it is still supported between the suction plate 10 and the suction counter-plate 11 which are spaced apart from one another. The stretchers of each pair are then moved apart and lowered in order to stretch the sleeve transversely and to displace it vertically so that it can be slipped onto the bottle 3 arranged in the vertical position. The suction applied to the sleeve by the plates 10 and 11 is of course interrupted at this stage of the operation.

Each stretcher of the pairs of stretchers comprises a body 30 in the form of a right-angle bracket of which the vertical portion 31 is in the form of a segment of a cylinder having a circular cross-section or the like. The size and shape of the internal face $\mathbf{31_1}$ of this segment correspond substantially to the diameter of the bottle 3 to be labelled.

The body 30 comprises a network of channels 32 which open out in grooves 33 on the external face of the segment 31. The external face of the segment 31 then receives, in sealing manner, a curved plate 34 of which the convex external face is smooth. This plate is provided with perforations $\mathbf{34_1}$ which open out in the grooves 33. The channel network 32 is connected by a connecting piece 35 to a flexible tube $\mathbf{35_1}$ which is connected by means of a switch on the one hand to a suction source and on the other hand to an air-blowing source (not shown). The switch is formed, for example, by a slide valve distributor, one of the pilot valves of which is actuated by means of a finger also arranged on a stationary portion of the barrel.

The operating cycle of the machine according to the invention could, for example, be such that the bottles to be labelled are positioned at 17, each on one of the stations $\mathbf{2_1}$ of the barrel, and are then removed at 18 when they have been labelled.

In the course of the continuous rotation of the barrel, the suction counter-plates 11 are placed on the separated sleeves 5 supported by the suction plate 10 in the course of sector 19 of the rotation cycle and then the plates and counter-plates move apart from one another at sector 20 in order to bring the sleeves into the open position $5_1$. Also during this period, the stretchers 13, which are closed, are raised in the course of sector 21 of the rotation cycle and are then introduced at the beginning of sector 22 into an open sleeve $5_1$ as shown at $22_1$. The stretchers are moved apart from one another at sector 23 in order to stretch the sleeve transversely as shown at $23_1$.

In the course of this rotation of the barrel in sector 23, pressurised air is introduced into the channels 32 of each of the stretchers in order to lift the internal wall of the stretched sleeve 5 to a slight extent from the external wall of the stretchers and thus to enable the stretching of the sleeve to be distributed over its entire periphery. This blowing-in of air is preferably carried out in sector $23_2$ close to the end of sector 23 in the course of the rotation of the barrel.

Then, at sector 24, the channels 32 of the stretchers are placed under reduced pressure in order to apply suction to the internal wall of the sleeve which thus remains securely fixed to the external wall of the stretchers during their descending movement, in the course of sector 24, in order to slip the sleeve onto the bottle as shown at $24_1$.

The height of the stretchers 13 is less than that of the sleeves 5, so that the transverse stretching of the sleeves affects the upper area of the sleeves very little if at all. Thus, during the descent of the stretchers in the course of sector 24, in order to slip the sleeves onto the bottles, the upper area of the sleeves, which are, in addition, securely maintained on the stretchers as a result of the suction, slides by friction onto the bottles, although this frictional force is less than the force maintaining the sleeve on the stretchers by suction. The frictional force of the sleeve on the bottle is preferably reduced by the presence of a flow of air during their relative displacement.

This flow of air is obtained by providing the stretchers with a network of channels 36 which are connected to an air-blowing means (not shown) and open out on the region $34_2$ of the stretchers in order to produce a blast of air oriented in the opposite direction to that in which the sleeve is slipped onto the bottle.

At the end of sector 24, the sleeves 5 which are still in the state stretched by the stretchers 13 are positioned at the desired level on the bottles 3 and it is then appropriate to remove the stretchers 13 without moving the sleeve 5 in relation to the bottle and to allow the sleeve to contract onto the bottle.

This is achieved at sector 25 of the operating cycle, during which, as of the beginning of cycle 25, the blowing-in of air via the network of channels 36 is stopped and air is blown under pressure into the channels 32 of the stretchers in order to lift the sleeve from the external face of the stretchers and thus to enable them to become disengaged towards the bottom with respect to the sleeve, the upper edge of which remains held by friction on its bottle.

At the end of sector 25, the stretchers are thus removed, via the bottom, from the sleeve 5 and the bottle is discharged at 18 while the bottle-receiving station is already provided with the sleeve taken up by the suction plate 9 and then by the plate 10 in order to apply a label to the next bottle introduced at 17 at this same receiving station $2_1$.

As shown in the appended drawings, the channels 33 are preferably used both for suction and for blowing. It will be appreciated that, if desired, two separate channel networks may be provided.

I claim:

1. Process for fitting a stretchable sleeve on an article, according to which at least one pair of stretchers is introduced into the sleeve, the stretchers are moved apart in order to stretch the sleeve, and the article and the stretchers are displaced relative to one another in order to position the stretched sleeve on the article, which process is characterised in that, the stretchers each define an external face that comes into contact with the sleeve while the sleeve is being fitted on the article and, during the relative displacement of the stretched sleeve and the article, suction is effected in the area of contact of the sleeve and the external faces of the stretchers in order to maintain the sleeve on the stretchers while it is being fitted on the article.

2. Process according to claim 1, characterised in that, before the suction operation, air is blown into the area of contact of the sleeve and the external faces of the stretchers.

3. Process according to claim 1, characterised in that, during the relative displacement of the stretched sleeve and the article, suction is effected on the sleeve through at least one first perforation in the external faces of the stretchers and air is blown between the sleeve and the article through at least one second perforation in the stretchers.

4. Process according to claim 3, characterised in that the at least one second perforation in the stretchers is formed in an upper region of the stretchers that is outside of the area of contact between the stretchers and the sleeve and the stretchers comprise a network of channels which are connected to an air-blowing means and open out on the at least one second opening and produce a blast of air oriented in the opposite direction to that in which the sleeve is slipped onto the article.

5. A method of fitting a stretchable sleeve onto an article, comprising the steps of:

opening the stretchable sleeve into a first configuration in which the article may not be inserted into the stretchable sleeve;

providing a plurality of stretchers each having an inner surface, an outer surface, an upper surface, and at least one first channel opening out on each of the outer surfaces;

displacing at least one of the stretchable sleeve and the plurality of stretchers such that the stretchers enter the stretchable sleeve and the outer surfaces come into contact with the stretchable sleeve while the stretchable sleeve is being fitted onto the article;

displacing the stretchers such that the outer surfaces thereof engage and stretch the stretchable sleeve into a second configuration in which the article may be inserted into the stretchable sleeve;

applying suction to the stretchable sleeve through the first channels;

displacing at least one of the article and the stretchers such that the article is arranged between the inner surfaces of the stretchers; and removing the stretchers to fit the stretchable sleeve onto the article.

6. A method as recited in claim 5, further comprising the step of applying fluid pressure to the stretchable sleeve through the first channels while the stretchers are removed to fit the stretchable sleeve onto the article.

7. A method as recited in claim 5, in which a height of the stretchers is less than that of the stretchable sleeve such that a portion of stretchable sleeve is not fully stretched when the stretchers are displaced to stretch the stretchable sleeve.

8. A method as recited in claim 7, further comprising the step of blowing fluid between the article and the portion of the sleeve that is not fully stretched during the step of displacing at least one of the article and the stretchers such that the article is arranged between the inner surfaces of the stretchers.

9. A method as recited in claim 8, in which, during the step of displacing at least one of the article and the stretcher, s such that the article is arranged between the inner surfaces of the stretchers, the sleeve is displaced in a first direction relative to the article, further comprising the step of blowing air in a second direction substantially opposite to the first direction through at least one second channel opening out on the upper surface of each of the stretchers.

10. A method as recited in claim 5, further comprising the step of applying fluid pressure to the sleeve through the first channels during the step of displacing the stretchers to stretch the stretchable sleeve into the second configuration.

11. An apparatus for fitting a stretchable sleeve onto an article, comprising:

means for placing the stretchable sleeve into a first configuration in which the article may not be inserted into the stretchable sleeve;

a plurality of stretchers each having an inner surface, an outer surface, an upper surface, and at least one first channel opening out on the outer surfaces thereof;

means for displacing at least one of the stretchable sleeve and the plurality of stretchers such that the stretchers enter the stretchable sleeve;

means for displacing the stretchers such that the outer surfaces thereof engage and stretch the stretchable sleeve into a second configuration in which the article may be inserted into the stretchable sleeve;

means for applying suction to the stretchable sleeve through the first channels;

means for displacing at least one of the article and the stretchers such that the article is arranged between the inner surfaces of the stretchers; and means for removing the stretchers to fit the stretchable sleeve onto the article.

12. An apparatus as recited in claim 11, further comprising means for applying pressurized fluid to the stretchable sleeve through the first channels.

13. An apparatus as recited in claim 12, further comprising switch means for connecting one of a source of pressurized fluid and a fluid vacuum to the first channels.

14. An apparatus as recited in claim 11, in which the stretchers comprise:

a body having grooves formed therein; and a plate in which at least one perforation is formed; wherein the plate is attached to the body such that the grooves form the channels and are in fluid communication with the perforations.

15. An apparatus as recited in claim 11, in which the stretchers each comprise at least one second channel through which pressurized fluid is directed between the article and the stretchable sleeve.

* * * * *